US009533827B2

(12) United States Patent
Le Palud et al.

(10) Patent No.: US 9,533,827 B2
(45) Date of Patent: Jan. 3, 2017

(54) RUBBISH COLLECTION VEHICLE WITH AN IMPROVED CONTAINER LIFTER

(71) Applicant: PB ENVIRONNEMENT, Lambesc (FR)

(72) Inventors: Frédéric Le Palud, Vitrolles (FR); Philippe Quarteroni, Lancon de Provence (FR); Christian Reverdy, La Ciotat (FR)

(73) Assignee: PB Environment, Lambesc (FR)

( * ) Notice: Subject to any disclaimer, the term of this patent is extended or adjusted under 35 U.S.C. 154(b) by 0 days.

(21) Appl. No.: 14/646,189

(22) PCT Filed: Nov. 19, 2013

(86) PCT No.: PCT/FR2013/052778
§ 371 (c)(1),
(2) Date: May 20, 2015

(87) PCT Pub. No.: WO2014/080117
PCT Pub. Date: May 30, 2014

(65) Prior Publication Data

US 2015/0314958 A1 Nov. 5, 2015

(30) Foreign Application Priority Data

Nov. 20, 2012 (FR) ..... 12 61022

(51) Int. Cl.
*B65F 3/04* (2006.01)
*B65F 3/02* (2006.01)

(52) U.S. Cl.
CPC ..... *B65F 3/045* (2013.01); *B65F 3/046* (2013.01); *B65F 2003/0223* (2013.01)

(58) Field of Classification Search
CPC ..... B65F 3/045; B65F 3/046
See application file for complete search history.

(56) References Cited

U.S. PATENT DOCUMENTS 4,305,693 A * 12/1981 Naab ..... B65F 3/045 414/408
4,613,271 A * 9/1986 Naab ..... B65F 3/045 403/347
4,645,018 A * 2/1987 Garbade ..... B65F 3/045 177/139
4,722,658 A * 2/1988 Wurtz ..... B65F 3/045 414/404
4,773,812 A 9/1988 Bayne et al.
4,824,315 A * 4/1989 Naab ..... B65F 3/045 177/139
5,002,450 A * 3/1991 Naab ..... B65F 3/045 414/303
5,344,272 A * 9/1994 Nuyts ..... B65F 3/041 177/139

FOREIGN PATENT DOCUMENTS

DE 3500691 A1 7/1986
DE WO 9928216 A1 * 6/1999 ..... B65F 3/045

(Continued)

*Primary Examiner* — Kaitlin Joerger
(74) *Attorney, Agent, or Firm* — Jordan IP Law, LLC; Todd A. Vaughn

(57) ABSTRACT

A container lifter and a low-encumbrance rubbish collection bin that can be used for a rear loading rubbish collection vehicle.

20 Claims, 6 Drawing Sheets

(56) References Cited

FOREIGN PATENT DOCUMENTS

| | | | | | |
|---|---|---|---|---|---|
| DE | 19919879 | A1 | * | 11/2000 | ..... B65F 3/045 |
| DE | 10221828 | C1 | * | 6/2003 | ..... B65F 3/045 |
| DE | EP 1619143 | A1 | * | 1/2006 | ..... B65F 3/045 |
| EP | 0512469 | A1 | | 11/1992 | |
| FR | 2153053 | A1 | | 4/1973 | |
| FR | 2461667 | A1 | | 2/1981 | |
| SI | 9900106 | A | | 8/1999 | |

* cited by examiner

RUBBISH COLLECTION VEHICLE WITH AN IMPROVED CONTAINER LIFTER

CROSS-REFERENCE TO RELATED APPLICATIONS

The present application is a National Stage Application of PCT International Application No. PCT/FR2013/052778 (filed on Nov. 19, 2013), under 35 U.S.C. §371, which claims priority to French Patent Application No. A 1261022 (filed on Nov. 20, 2012), which are each hereby incorporated by reference in their respective entireties.

TECHNICAL FIELD

This invention relates to a container lifter and a low-encumbrance rubbish collection bin that can be used for a rear loading rubbish collection vehicle.

BACKGROUND

There are many container lifter systems for rear loading rubbish collection vehicles (RCVS). French Patent Publication No. FR 1522813 A1 (Zöller) describes a container lifter allowing for the vertical raising of the container, but this raising is carried out by sliding on rails.

German Patent Publication No. DE 2920900 A1 (Stratmann), European Patent Publication No. EP 0122493 A1 (Schmitt), German Patent Publication No. DE 3500691 A1 (Schmitz), Slovenian Patent Publication No. SI 9900106 A, and European Patent Publication No. EP 0169558 A2 (Hermes) describe container lifters with four arms.

Patent application GS 2224261 (Allen) describes a container lifter that makes it possible to raise the container in vertical position, followed by a complete tipping. U.S. Pat. No. 5,513,937 (Automated Refuse Equipment) describes a container lifter which makes it possible to raise the container in vertical position and according to a substantially vertical trajectory, but the system is rather complex. U.S. Pat. No. 6,551,046 and WO 2000/66462 (Zöller) describe container lifters that allow for a vertical displacement with very little horizontal movement, but these systems are also of complex manufacture and operation.

French Patent Publication No. FR 1424273 (Zöller) and European Patent Publication No. EP 0820941 (C L G Inversiones) describe container lifters comprising a parallelogram geometry, which makes it possible to carry out the displacement of the container to be emptied in two phases: a phase of vertical raising followed by a tipping phase.

European Patent Publication No. EP 0512469 A1 (Waste Hoists) describes a compact container lifter that allows for a vertical raising of the container, then a tipping. It comprises two arms which make it possible to lift the container to its highest position, followed by a mechanical tipping. More precisely, this system comprises a main arm intended to be pivotably mounted on a frame about a first right-left axis (called here A1), intended to take a bottom position and a top position relative to a low-high direction, a reinforcement pivotably mounted on the main arm about a second right-left axis (called here A2), a seat mounted on the reinforcement and intended to receive a container so as to raise same, an auxiliary arm intended to be pivotably mounted on the frame about a third right-left axis (called here A3), and pivotably mounted on the reinforcement about a fourth right-left axis (called here A4). In this system, the distance between the axes A2 and A4 is almost equal to the distance between the axes A1 and A3.

Furthermore, the distance between the axes A1 and A2 is almost equal to the distance between the axes A3 and A4. As such, this container lifter almost forms a parallelogram, which allows the reinforcement—and therefore also the seat—to always remain vertical. This has the disadvantage that it can be difficult to raise a container on the seat when the ground is on a slope towards the rear and the top of the container is towards the rear in relation to the bottom of the container. Indeed, the container is often attached to the seat from the top. It is then necessary for the loader to raise the container in order to nest it on the seat. Furthermore, as the reinforcement remains vertical in the top position of the main arms, it is necessary to provide a substantial pivoting of the seat in relation to the reinforcement, much higher than 90°. This requires substantial efforts and takes time.

Other container lifter systems are described in documents French Patent Publication No. FR 2461667 (SITA), U.S. Pat. No. 4,773,812 (Bayne Machine Works, Inc.) and French Patent Publication No. FR 2153053 (Sulo Eisenwerk).

In particular, the container lifter systems according to prior art are not well suited to be provided on rear loading RCVS of small size. Indeed, next to large-size RCVS, there is a real need for RCVS with a more reduced size. This need exists in particular for small municipalities, or in municipalities that have narrow and/or sloped streets, for example in mountain villages. In order to reduce the encumbrance of these vehicles and in order to adapt them to the operation in tight areas, it is sought to decrease the functional zone of the container lifter. In particular, it is desired that the projection of the functional zone over the horizontal be small, in order to not destabilize the RCV during the lifting of very heavy containers, and in order to reduce its encumbrance during operation. Moreover, such a container lifter system will have to be able to grasp waste bins of very different sizes. And finally, it must be of simple, light and robust construction. And finally, it would be advantageous for it to be able to be mounted, without undergoing any constructive modifications, on the side of the vehicle and not at the rear, as there is also a need for RCVS of small size with lateral loading.

In order to overcome at least partially the disadvantages of known container lifters, a container lifter for RCV with rear load is proposed, improved by a particular geometry. This container lifter is also suitable for a lateral loading RCV.

SUMMARY

A first purpose of the invention is to propose a container lifter for RCV with rear loading that has a reduced encumbrance during operation.

Another purpose of the invention is to propose a container lifter for RCV with rear loading that is suitable for RCVS of small size, and which has a high degree of maneuverability.

Another purpose of the invention is to propose a container lifter for a RCV with rear loading that is suitable for RCVS of small size, and which has a high level of safety for the loaders. In particular, it is desired to prevent two risks: the crushing of the loader behind the container that is being raised (this risk is increased in the case of RCVS of small size that have to operate in alleys with a reduced lateral and/or rear space), and the risk linked to containers that spill when descending, in particular when the grasping system releases the container although the latter is not yet in a fixed position on the ground. Generally, it is desired that the container lifter system put the container back exactly to the location from which it was grasped, and without risk of spilling the container.

Another purpose of the invention is to propose a container lifter for a RCV with rear loading that is rapid, light and robust, able to operate with cylinders of small size, and that consumes little energy.

Yet another purpose is to propose a container lifter that can be used in an RCV in rear load mode or in lateral load mode.

These purposes are achieved by a container lifter for rear loading rubbish collection vehicle comprising: at least one main arm intended to be pivotably mounted on a frame about a first right-left axis, called the axis A11, intended to take a bottom position and a top position relative to a low-high direction; a reinforcement pivotably mounted on said main arm about a second right-left axis, called the axis A12; a seat mounted on the reinforcement and intended to receive a container so as to raise same; at least one auxiliary arm intended to be pivotably mounted on the frame about a third right-left axis, called the axis A13, and pivotably mounted on the reinforcement about a fourth right-left axis, called the axis A14, characterized in that the distance between the axes A12 and A14 (D24) is greater than the distance between the axes A11 and A13 (D13).

This container lifter system, which constitutes the first object of the invention, has the following advantages: when the main arm is raised, the top of the seat tips towards the front in relation to the bottom of the seat, this starts the pouring, and when the main arm is lowered, the top of the seat tips towards the rear in relation to the bottom of the seat, which allows for an easier engagement of the comb. Moreover, the raising is carried out close to the rear wall of the RCV.

The distance between the axes A12 and A14 (D24) is advantageously greater than at least 10% of the distance between the axes A11 and A13 (D13), more preferably by at least 20%, and still more preferably by at least 30%. The distance between the axes A13 and A14 (D34) is advantageously greater than the distance between the axes A11 and A12 (D12). The distance between the axes A13 and A14 (D34) is advantageously greater than at least 5% of the distance between the axes A11 and A12 (D12), more preferably by at least 10%. The axis A11 is located advantageously above the axis A13, and wherein the axis A12 is located above the axis A11.

In an embodiment, the seat has a comb pointed upwards intended to nest into a front edge turned towards the bottom of the container, in such a way that the inside of the turned front edge is bearing on the comb. Advantageously, the seat has an abutment directed towards the rear, against which a front face of the container is intended to bear.

The chaise is pivotably mounted on the reinforcement about a fifth right-left axis, called the axis A15, and intended to selectively take a position thrust against the reinforcement between the bottom position and the top position of the main arm or arms, and an unloading position when the main arm or arms are in top position, wherein the seat has pivoted about the axis A15, in such a way that the container received on the seat has also pivoted about the axis A15 and can be emptied of its contents. Advantageously, the axis A15 is located above the axis A12.

When the main arm or arms are in bottom position, the axis A11 is above the axis A12, and when the main arm or arms are in top position, the axis A12 is above the axis A11.

When the main arm or arms are in bottom position, the perpendicular to the axes A11 and A12 forms an angle (delta 12) with a forwards-backwards direction between −50° and −75°, and when the main arm or arms are in top position, the perpendicular to the axes A11 and A12 forms an angle with the forwards-backwards direction between 50° and 75°.

When the main arm or arms are in bottom position, the angle between the perpendicular to the axes A11 and A12 and the perpendicular to the axes A13 and A14 is between 0 and −5°, and when the main arm or arms are in top position, the angle between the perpendicular to the axes A11 and A12 and the perpendicular to the axes A13 and A14 is between 10° and 20°, and more preferably between 12° and 18°.

In an advantageous embodiment, which is suitable for most containers, the distance between the axes A11 and A12 (D12) is at least 60 cm, and more preferably at least 70 cm.

The container lifter according to the invention can further comprise a clamp used as a removable pouring edge, pivotably mounted on the seat about a sixth right-left axis, called the axis A16. Said clamp is intended to take, when the seat is in thrust position against the reinforcement, a lowered position wherein the clamp allows the container to be received on the seat, and, when the seat is in unloading position, a raised position wherein the clamp is intended to facilitate the unloading of the contents of the container. Advantageously, the clamp comprises a rear edge, wherein, in lowered position, the rear edge is cleared of the comb, and wherein, in raised position, the rear edge is located facing the comb inn such a way that the front turned edge of the container received on the seat is clamped between the comb and the rear edge of the clamp.

In the container lifter according to the invention, the auxiliary arm or arms are intended to adjust the inclination of the reinforcement about the axis A2 in such a way that the perpendicular to the axes A2 and A4 forms an angle (a24) between −15° and −10° in relation to the vertical when the main arm or arms are in bottom position, and in such a way that the perpendicular to the axes A2 and A4 forms an angle (a24) between 20° and 25° when the main arm or arms are in top position.

In an advantageous embodiment, which provides for a safe grasping and depositing of the container, in engaging position of the grasping system of the container, the angle σ3 defined by the angle between the straight line passing through the axes A13 and A14 on the one hand, and A11 and A12 on the other hand, is between −5° and +5°.

Another object of the invention is a rubbish collection vehicle (RCV) comprising a frame, a propulsion system according to a forwards-backwards direction, a caisson received on the frame and intended to store the contents of containers, a container lifter according to the invention mounted on the frame. This caisson can comprise a rear wall delimiting a rear opening through which the contents of the containers is intended to enter into the caisson, and wherein, when the main arm or arms are in top position, the clamp is in raised position, and when the seat is in unloading position, the clamp extends above the section of the rear wall, and more preferably rests on the section of the rear wall. Advantageously, the axes A11 and A13 are located under the caisson.

DEFINITIONS

"Rubbish collection vehicle (RCV)" means a vehicle used to collect and transport rubbish (for example, household waste, bulky waste, recyclable waste of which the loading is carried out either by rubbish containers, or by hand. An RCV comprises a chassis-cab whereon a superstructure is mounted. A "rear loading RCV" is an RCV wherein the rubbish is loaded into the caisson at the rear. The "caisson"

is the portion of the superstructure wherein the collected rubbish is transported. The "cab" is an enclosure mounted on the frame at the front of the superstructure and which shelters the driving position of the RCV with rear loading. The "superstructure" is the assembly of all of the components fixed on the chassis-cab of the RCV and including the caisson. The "capacity of the RCV" is the internal volume available for the rubbish. The "compacting mechanism" is the mechanism that makes it possible to compact and/or transfer the rubbish in the caisson.

"Container lifter" (*) here means a mechanism fixed on a RCV for the loading of rubbish into its caisson. A "container lifter for rubbish containers" is a mechanism installed on an RCV for the emptying of rubbish containers provided. A "built-in rubbish container lifter" (*) is a container lifter for rubbish containers designed to be permanently fixed on the caisson of the RCV.

"Grasping system" (*) means the portion or portions of the container lifter intended to be in contact with the rubbish container in order to receive its corresponding portion for the purposes of grasping, lifting and emptying.

"Comb grasping system" (*) means a horizontal row of teeth directed upwards and a system for locking intended to retain, during the emptying, the rubbish container.

"Functional zone" (*) means the space covered by the movements of the container lifter and of the rubbish container or containers provided when they are lifted by a container lifter.

"Emptying cycle of the rubbish container" means the succession of sequences required to grasp, raise, tip and empty the rubbish container provided and to set it back on the ground.

These definitions come from European standards EN 1501-1 (2011) or (*) EN 1501-5 (2011), known to those skilled in the art.

"Loader" means a refuse worker working behind the vehicle.

DRAWINGS

FIG. 1 shows a perspective view of a rubbish collection vehicle according to the invention.

FIG. 2 shows an exploded view of a system for raising containers according to the invention.

FIG. 3 show a perspective view of a system for raising containers according to the invention.

Figure 4:
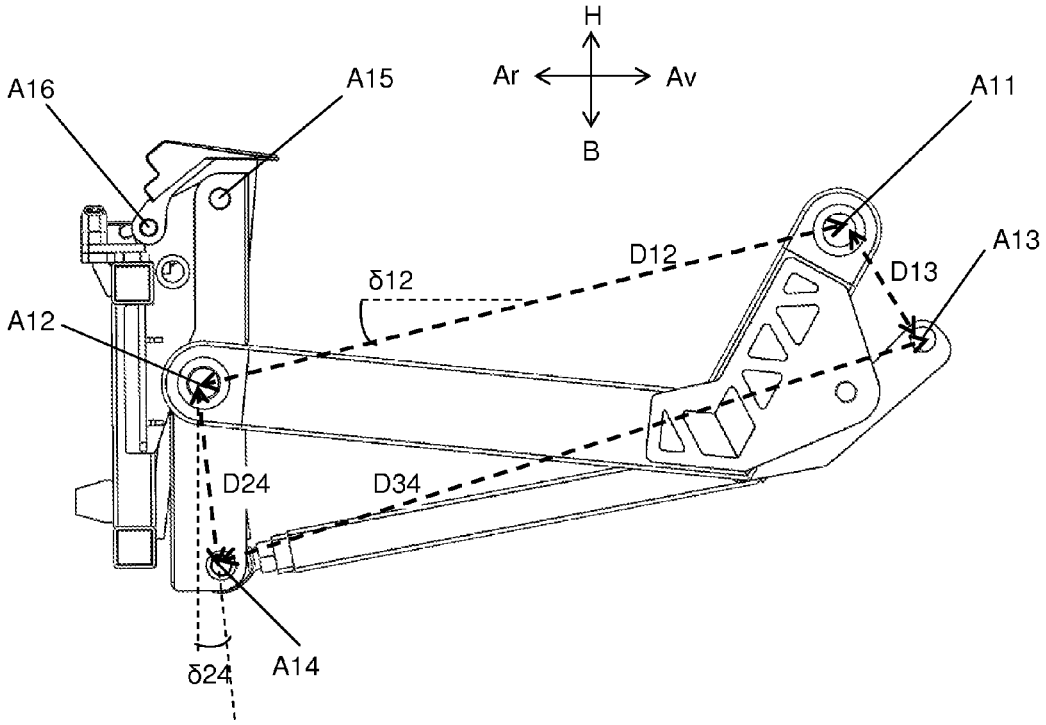

FIG. 4 diagrammatically shows the geometry of the system for raising containers according to the invention in a bottom position; it defines distances (D12, D13, D24, D34) in relation to the axes A11, A12, A13, A14, and angles δ12, δ24 in relation to the axes A12, A14 and the vertical and in relation to the axes A11, A12 and the horizontal, respectively.

FIGS. 5*a* to 5*f* show the kinematics of the system for raising containers.

FIGS. 6*a* to 6*d* show the kinematics of the system for raising containers.

FIGS. 7*a* to 7*d* show the kinematics of the system for raising containers.

Figure 8:
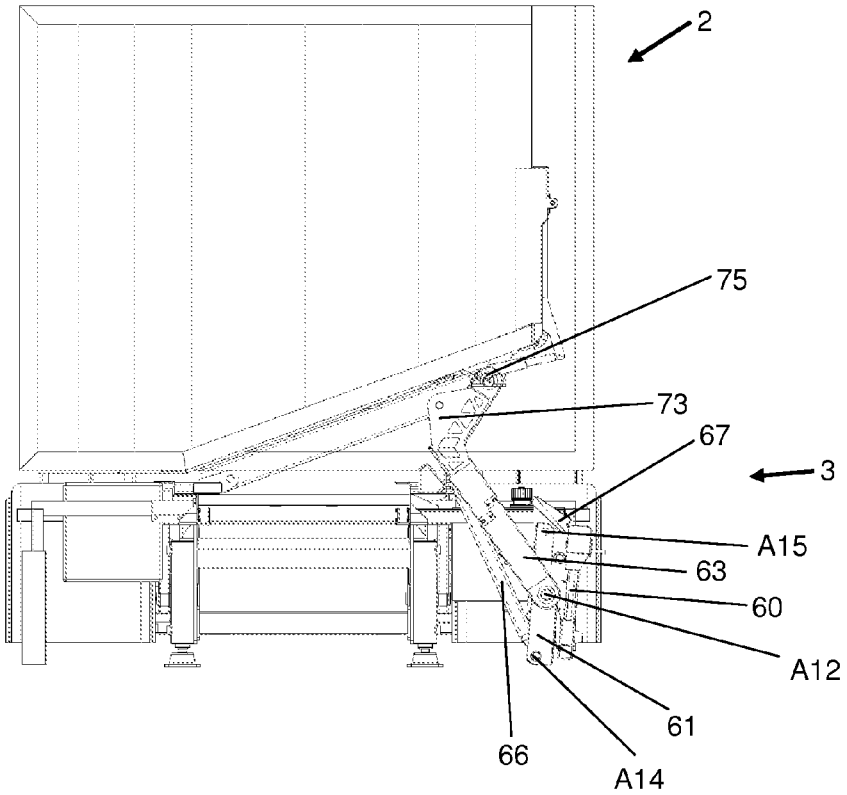

FIG. 8 shows a particular embodiment in which the system for raising containers according to the invention is mounted in such a way as to be able to be used on the left side of the vehicle.

Figure 9:
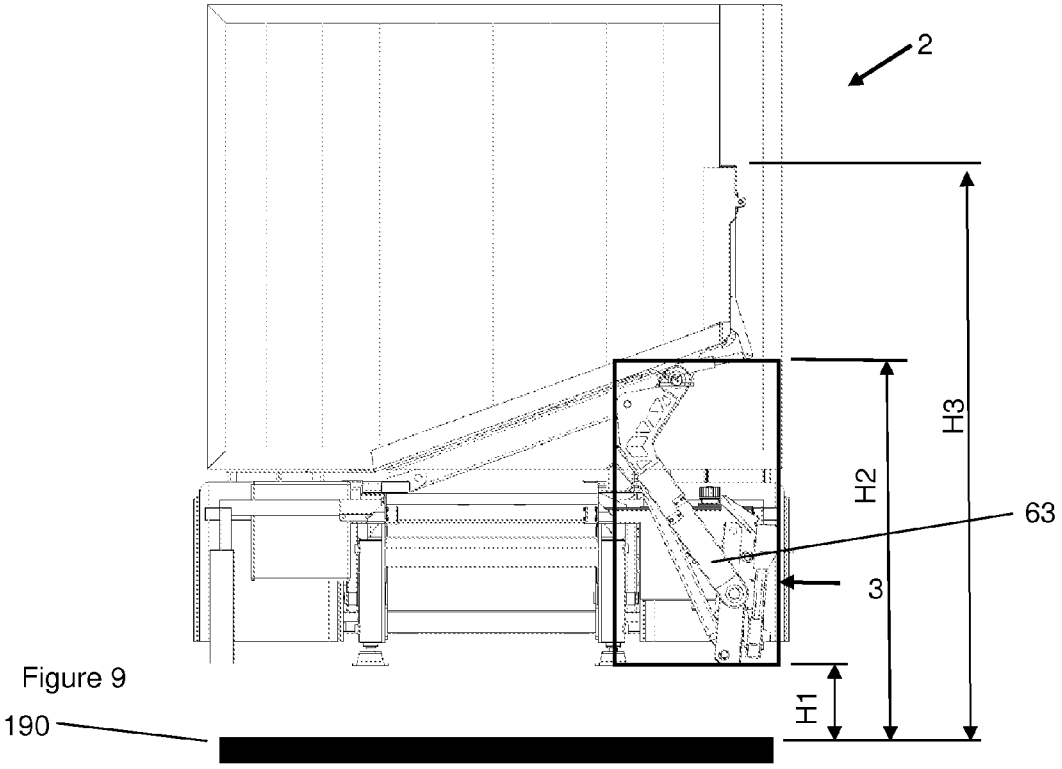

FIG. 9 defines certain parameters of height H1, H2, H3 useful for characterizing the method for raising and emptying containers according to the invention.

DESCRIPTION

Figure 1:
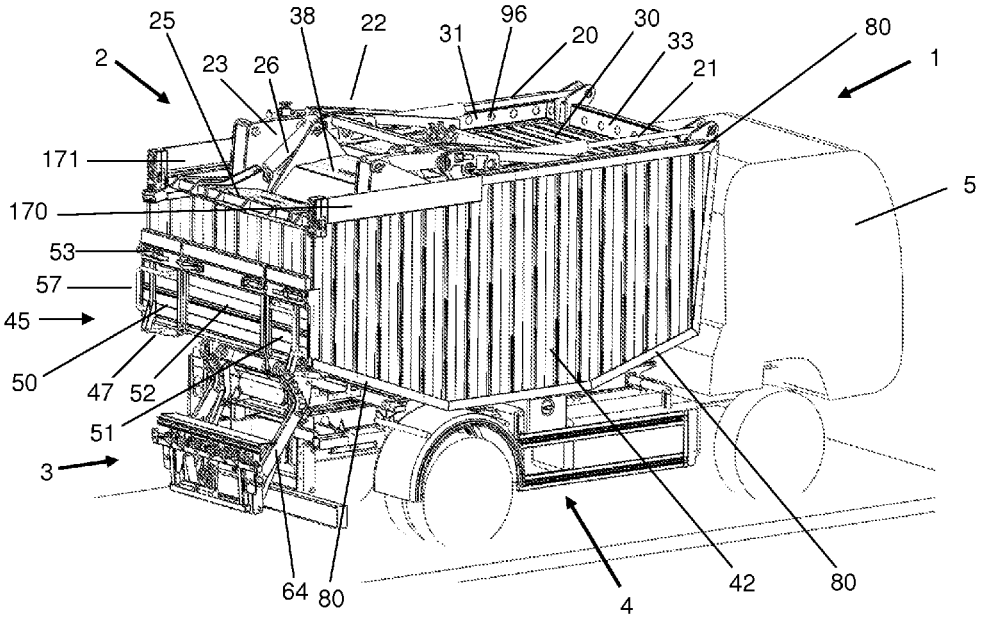
FIGS. 1 to 9 show the invention.

FIG. 1 shows an RCV 1 provided with a container lifter 3 according to the invention. This RCV typically comprises a frame 4 with a cab 5 and a superstructure comprising the caisson 2, a container lifter 3 and a compacting system. This RCV comprises a caisson 2 which is specially designed to be able to be mounted on a standard truck frame with a GVWR less than or equal to 10 t, and more preferably with a GVWR of 9 t or of 7.5 t. It comprises a system for compacting rubbish.

Figure 2:
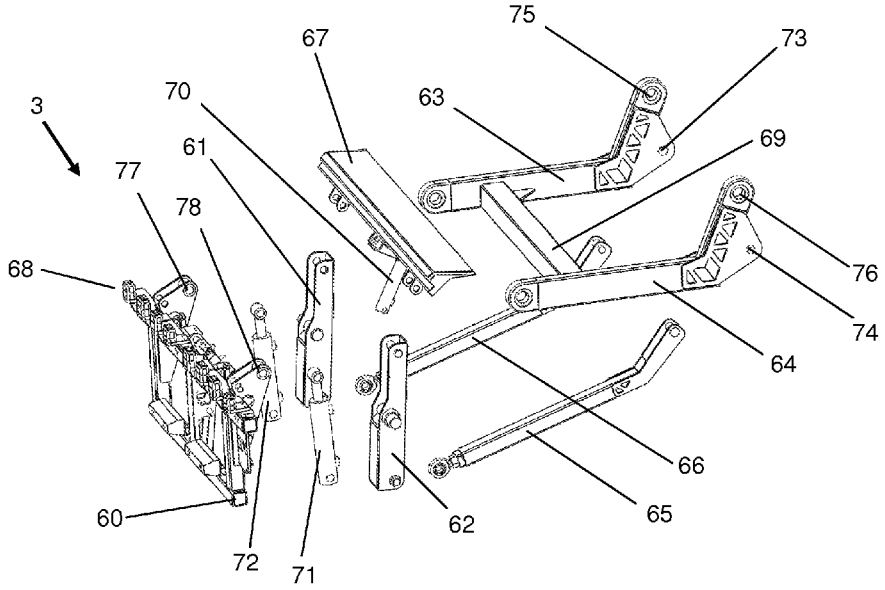
Figure 3:
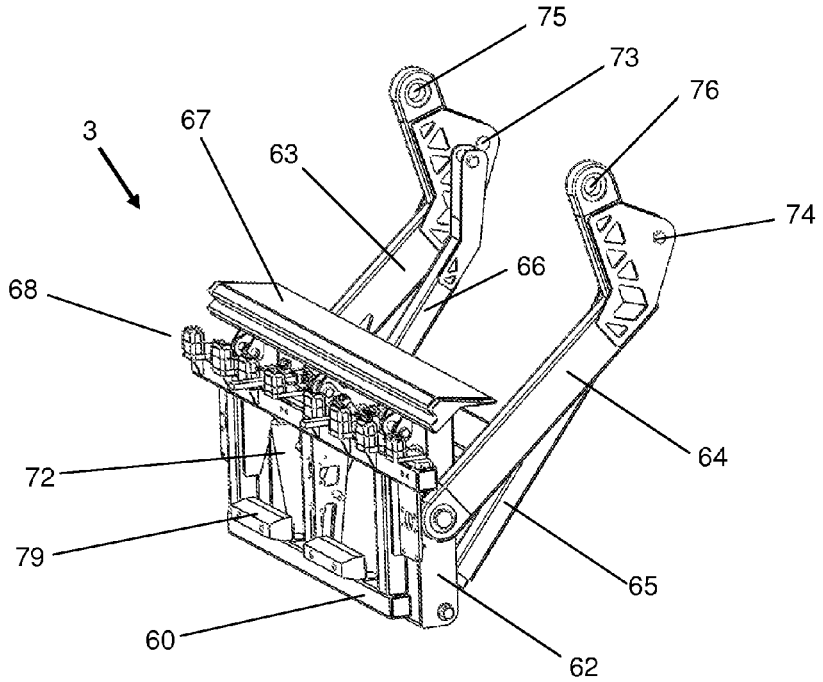

FIGS. 2, 3 and 4 show the container lifter system 3 in detail according to the invention. Its kinematics is explained in FIGS. 5, 6 and 7.

The container lifter system 3 according to the invention comprises at least one main arm 63, 64 intended to be pivotably mounted on a frame 4 about a first right-left axis, called the axis A11, intended to take a bottom position and a top position relative to a low-high direction, a reinforcement 61, 62 pivotably mounted on said main arm 63, 64 about a second right-left axis, called the axis A12, a seat 60 mounted on the reinforcement 61, 62 and intended to receive a container 180 so as to raise same, at least one auxiliary arm 65, 66 intended to be pivotably mounted on the frame 4 about a third right-left axis, called the axis A13, and pivotably mounted on the reinforcement about a fourth right-left axis, called the axis A14, said container lifter system characterized in that the distance between the axes A12 and A14 (D24) is greater than the distance between the axes A11 and A13 (D13).

Advantageously, the distance between the axes A12 and A14 (D24) is greater by at least 10% of the distance between the axes A11 and A13 (D13), more preferably by at least 20%, and even more preferably by at least 30%.

The container lifter system 3 according to the invention comprises three types of cylinders: at least one cylinder for lifting of the raising system (not shown in the Figures) which makes it possible to raise the main arm 63, 64, a cylinder 70 for actuating the clamp 67, and at least one cylinder 71, 72 for rotating.

The kinematics of the container lifter shall be described in detail according to the invention, in reference to FIG. 5. The emptying cycle of the rubbish container comprises two separate phases of raising and tipping.

In a first phase, the main arm is raised in a first step (FIG. 5*a*), which makes it possible to attach a small-size bin to the comb. In a second step, (FIG. 5*b*), the main arm is raised further, which makes it possible to alternatively attach a large-size bin to the comb. In a third step (FIG. 5*c*), the main arm is raised further in order to raise the bin to the beginning of the closing of the clamp. In a fourth step, the clamp is closed (FIG. 5*d*) on the upper edge of the bin; this step can be executed continuously during the raising. In another embodiment, the start of the closing of the clamp is triggered by an abutment position of the lifting cylinder.

In a second phase, which can be triggered by the automatism only when the first phase is completed, the rotation of the bin is started (FIG. 5*e*) then the rotation of the bin is completed (FIG. 5*f*) using an additional cylinder. This movement of rotation by the additional cylinder is sequenced: this rotation starts only when the main arm is in stopped position, as this stopped position automatically triggers the rotation by the additional cylinder 71.

Figure 5A:
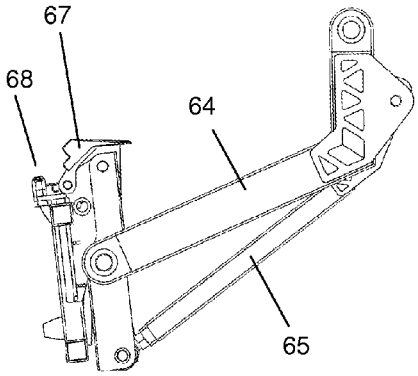
Figure 5B:
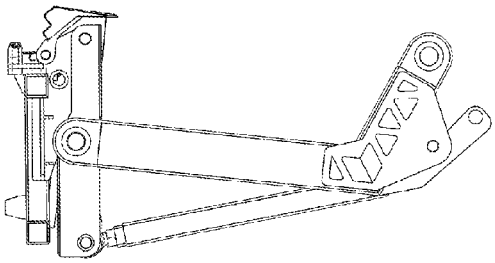
Figure 5C:
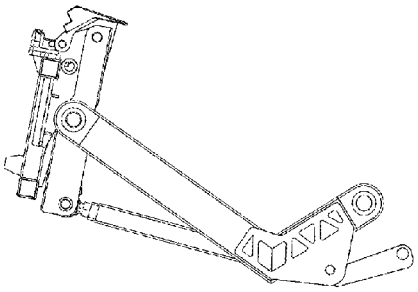
Figure 5D:
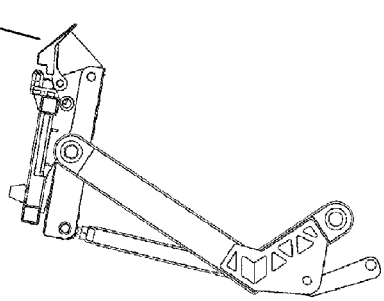
Figure 5E:
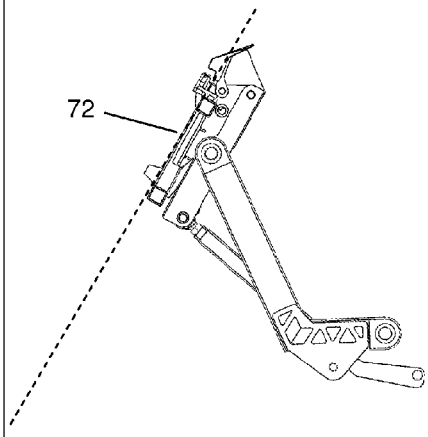
Figure 5F:
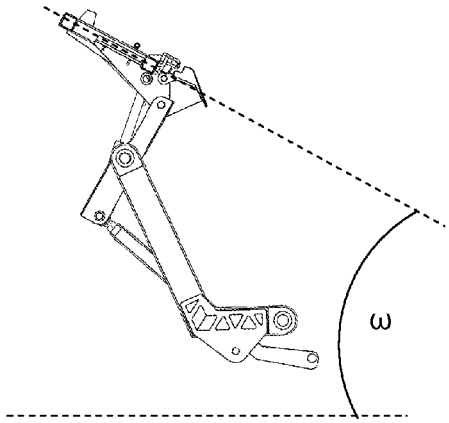

The tipping angle during this second phase (between the positions of FIGS. 5*e* and 5*f*) is about 90° (see the angle between the dotted line in FIG. 5*e* and that in FIG. 5*f*) in order to reach an angle of inclination at emptying of about 42° (see the angle ω (omega) in FIG. 5*f*). This angle is significantly lower than in most of the existing systems; it allows for tipping that is easier, faster, and with less wear and tear, and is particularly suited for heavy bins. This lower tipping angle of 90° is obtained thanks to a raising system that provides a raising that is not entirely vertical, but which nevertheless has a reduced encumbrance (functional zone).

The emptying cycle of the rubbish container is then supplemented by the inverse tipping and the descent of the container (not shown in the Figures); the container is placed on the ground in the same location from which it was grasped by the comb. The depositing of the container is done "flat", over its entire surface intended to be in contact with the ground, without risk of tipping.

In the container lifter according to the invention, the auxiliary arm or arms 65, 66 are intended to adjust the inclination of the reinforcement about the axis A2 in such a way that the perpendicular to the axes A2 and A4 forms an angle (a24) between −15° and −10° in relation to the vertical when the main arm or arms are in bottom position, and in such a way that the perpendicular to the axes A2 and A4 forms an angle (a24) between 20° and 25° when the main arm or arms are in top position. This angle is negative when A14 is in front of A12 (see FIG. 5*a*) and positive when A14 is behind A12 (see FIG. 5*f*).

FIG. 6 gives another description of the kinematics of the container lifter according to the invention. FIG. 6*a* corresponds to FIG. 5*a*. FIG. 6*b* corresponds to FIG. 5*b*. FIG. 6*c* corresponds to FIG. 5*e*; it shows the system in raising position of the main arm 64, with the comb 68 raising the upper edge of the tray. FIG. 6*d* corresponds to FIG. 5*f*.

Figure 6A:
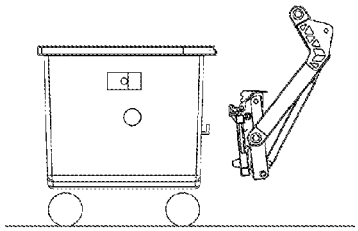
Figure 6B:
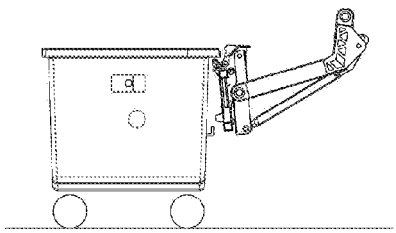
Figure 6C:
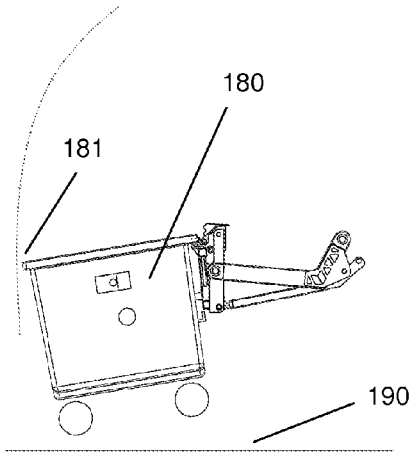
Figure 6D:
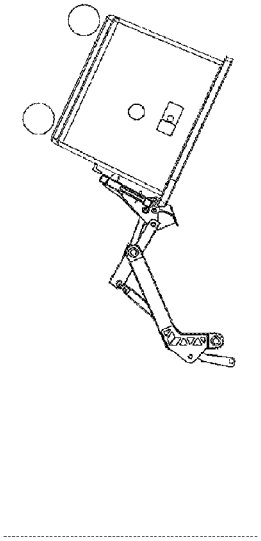

FIG. 6*c* shows the line that describes the rear edge 181 of the bin 180 when it is raised: note that its raising is practically vertical. This is an important aspect which prevents the risk of the loader being crushed against an obstacle located behind the RCV. However, it is not entirely vertical, and this is advantageous, as shall be explained hereinbelow.

The height of the top point of the bin in tipping position is typically between 170 and 200 cm in relation to the surface of the ground 190, more preferably between 180 cm and 190 cm, while it is about 120 to 130 in most of the systems used. The height of the comb in grasping position of a standardized bin is still between 80 cm and 110 cm.

Figures 7A, 7B, 7C, 7D:
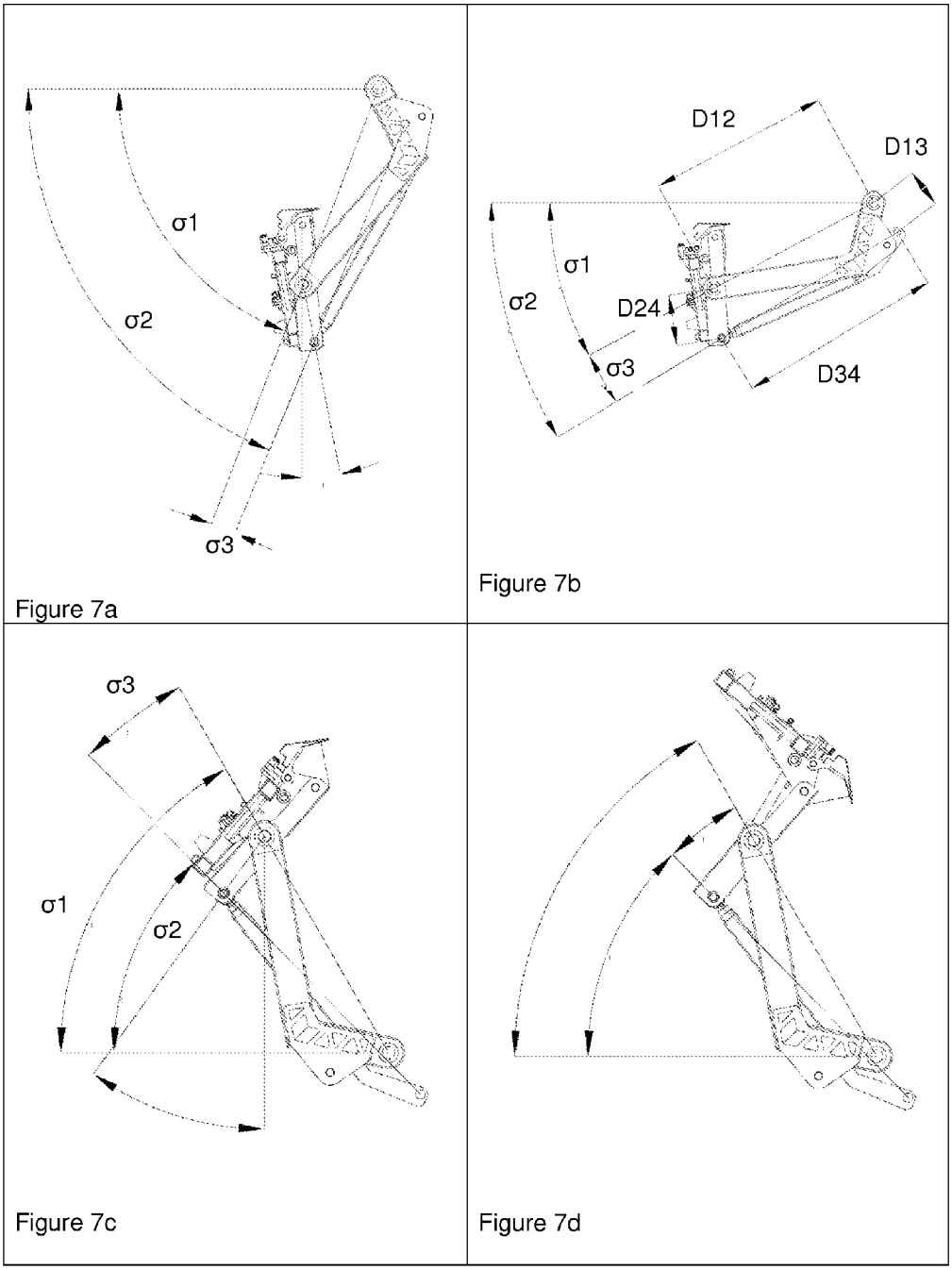

FIG. 7 further gives another description of the kinematics of the container lifter according to the invention. FIG. 7*a* corresponds to FIG. 5*a*. FIG. 7*b* corresponds to FIG. 5*b*. FIG. 7*c* corresponds to Figure Se. FIG. 7*d* corresponds to FIG. 5*f*. The auxiliary arm 65 defines the angle of the seat in relation to the ground 190. According to the invention, in engaging position of the grasping system of the container (FIGS. 7*a* and 7*b*), the angle σ3 is between −5° and +5°. This provides for a practically vertical raising of the container lifter to the grasping height of the container, allowing for a safe grasping (via a grasping system with a comb, as in the Figures, or via another system) and a safe depositing of the container after it has been emptied. More particularly, in the bottom grasping position (FIG. 7*a*), the angle σ3 is advantageously between 0 and −5°, and in the top grasping position (FIG. 7*b*) between 0° and +5°.

It can be seen that the container lifter system according to the invention allows for a practically vertical raising and a tipping close to the rear wall of the caisson 2 (here: close to the swing gate 45). This has an advantage during the raising (the initial almost vertical raising facilitates the grasping of containers of different sizes) and the lowering (the depositing of the container is done flat, for large containers on the four wheels, which excludes any risk of tipping of the container).

However, the raising is not entirely vertical, and this has the advantage that the container is already in an inclined position (FIG. 7*c*) when the final tipping movement is triggered (FIG. 7*d*). Thanks to the invention, it is therefore possible to configure the container lifter in such a way that in the bottom position of the main arm or arms, the reinforcement—and therefore the seat are inclined in such a way that the top of the seat is located at the rear of the bottom of the seat. As such, the top of the seat can nest more easily with the top of the container. Furthermore, thanks to the invention, it is possible to configure the container lifter in such a way that in the top position of the main arm or arms, the reinforcement is inclined in such a way that the top of the reinforcement is advanced in relation to its bottom, as such initiating the tipping of the container. As such, the pivoting of the seat in relation to the reinforcement can be reduced to about 90°.

This container lifting system makes it possible to reduce the size of the functional zone, and it makes it possible to lighten the tipping system for heavy containers. When the container reaches its top position, it is very close to the emptying zone, and it is not necessary to bring it closer to the vehicle before tipping it.

As shown in FIG. 8, the container lifter 3 according to the invention can be used in the rear portion of the vehicle (rear loading vehicle) as well as on the side of the vehicle (lateral loading vehicle, also called by those skilled in the art a vehicle of the "side loader" type), without any modification to the design of the container lifter 3; this increases its versatility.

As shown in FIG. 9, and this applies to its rear raising as well as to its lateral raising, the container lifter according to the invention can be mounted on the chassis of standard range utility vehicles that has, in an advantageous embodiment, typically a height of the upper face of the frame sliders of about 800 mm in relation to the ground 190.

In a particular embodiment, which is in particular suitable for lateral raising, the container lifter is sized in such a way as to allow the container 180 to be emptied at a minimum height of 2200 mm (parameters H3) while still being compact in its bottom position (stored position when the vehicle is moving) since its top point is at most 1400 mm (parameter H2).

Generally, the container lifter is advantageously sized in such a way as to retain a space under the container lifter 3, called the "ground clearance" (parameter H1 shown in FIG. 9) that is sufficient to provide for movement in complete safety (H1 between 280 mm and 320 mm and more preferably between 280 mm and 300 mm). (Note that in FIG. 9, the tires of the vehicle are not shown.) This is obtained by a geometrical arrangement wherein the axis of rotation A15 is located above the axes A12 and A14. In addition, when it is in stored position (the bottommost position), the depth of the container lifter according to the invention is less than 600 mm, and more preferably less than 580 mm; typically it is between 550 mm to 600 mm. This makes it possible to house the container lifter 3 behind the vehicle or on the flank of the vehicle without exceeding the dimensions of the vehicle.

Used in a rear loading vehicle, the container lifter 3 according to the invention allows for the manual loading via the swing gate 52 at a height of about 1400 mm to 1500 mm from the ground 190, minimizing the rear overhand of the vehicle and facilitating the emptying by gravity of the caisson 2 without interference with the container lifter 3.

LIST OF REFERENCE NUMERALS

| | |
|---|---|
| 1 | Rubbish collection vehicle |
| 2 | Caisson |
| 3 | Container lift |
| 4 | Chassis |
| 5 | Cab |
| 20, 21 | Carrier cylinder |
| 22 | Sliding carrier |
| 23 | Pallet connecting rod |
| 25 | Lower scoop |
| 26 | Lower scoop cylinder |
| 30 | Roof |
| 31 | Sliding member |
| 33 | Front slider |
| 38 | Upper scoop |
| 40 | Caisson bottom (front portion) |
| 42, 43 | Lateral wall |
| 45 | Swing gate |
| 46 | Caisson bottom (rear portion) |
| 47 | Swing gate cylinder |
| 50, 51 | Lateral portion of the swing gate |
| 52 | Central portion of the swing gate |
| 53 | Manual means of locking |
| 57 | Handhold |
| 60 | Seat |
| 61, 62 | Riser |
| 63, 64 | Main arm |
| 65, 66 | Auxiliary arm |
| 67 | Clamp |
| 68 | Comb |
| 69 | Traverse |
| 70 | Cylinder to actuate the clamp |
| 71, 72 | Rotation cylinder |
| 73, 74 | Attachment point for the lift cylinder |
| 75, 76 | Attachment point for the rotation of the main arm |
| 77, 78 | Attachment point for the rotation of the seat |
| 79 | Lower abutment of the seat |
| 80 | Peripheral profile |
| 96 | Cap weld zone |
| 170, 171 | Protective strips |
| 180 | Tray |
| 181 | Rear edge of the tray |
| 190 | Ground |

The letters A1, A2, A3, A4, A5, A6, A11, A12, A13, A14, A15 and A16 designate axes. The letters D12, D13, D24 and D34 designate distances between axes.

What is claimed is:

1. A container lifter for rear loading rubbish collection vehicle, comprising:

at least one main arm pivotably mounted about a first pivot axis so as to take a bottom position and a top position relative to a low-high direction;

a reinforcement member pivotably mounted to the at least one main arm about a second pivot axis;

a seat mounted to the reinforcement member, and which is to receive a container so as to raise same; and at least one auxiliary arm pivotably mounted about a third pivot axis, and also pivotably on the reinforcement member about a fourth pivot axis;

wherein:

a spatial distance between the second pivot axis and the fourth pivot axis is greater than a spatial distance between the first pivot axis and the third pivot axis;

the seat is pivotably mounted to the reinforcement member about a fifth pivot axis so as to selectively take a position against the reinforcement member between the bottom position and the top position of the at least one main arm, and an unloading position when the at least one main arm is in the top position; and the seat is pivoted about the fifth pivot axis in such a way that the container received on the seat is also pivoted about the fifth pivot axis in order to be emptied of its contents.

2. The container lifter of claim 1, wherein:

the spatial distance between the second pivot axis and the fourth pivot axis is greater, by at least 30%, than the spatial distance between the first pivot axis and the third pivot axis; and or a spatial distance between the third pivot axis and the fourth pivot axis is greater, by at least 10%, than a spatial distance between the first pivot axis and the second pivot axis; and/or the first pivot axis is spatially located above the third pivot axis and the second pivot axis is spatially located above the first pivot axis.

3. The container lifter of claim 2, wherein the fifth pivot axis is spatially located above the second pivot axis.

4. The container lifter of claim 2, wherein the spatial distance between the first pivot axis and the second pivot axis is at least 70 cm.

5. The container lifter of claim 1, wherein:

when the at least one main arm is in the bottom position, the first pivot axis is spatially above the second pivot axis, and a plane lying perpendicular to the first pivot axis and the second pivot axis forms an angle in a range between −50° and −75°; and when the at least one main arm is in the top position, the second pivot axis is spatially above the first pivot axis, and the plane lying perpendicular to the first pivot axis and the second pivot axis forms an angle in a range between 50° and 75°.

6. The container lifter of claim 5, wherein:

when the at least one main arm is in the bottom position, an angle between the plane lying perpendicular to the first pivot axis and the second pivot axis, and a plane lying perpendicular to the third pivot axis and the fourth pivot axis, is in a range between 0 and −5°; and when the at least one main arm is in the top position, an angle between the plane lying perpendicular to the first pivot axis and the second pivot axis, and a plane lying perpendicular to the third pivot axis and the fourth pivot axis, is in a range between 12° and 18°.

7. The container lifter of claim 1, wherein the at least one auxiliary arm is to adjust an inclination of the reinforcement member about the second pivot axis in such a way that:

when the at least one main arm is in the bottom position, a plane lying perpendicular to the second pivot axis and the fourth pivot axis forms a first angle in a range between −15° and −10° in relation to the vertical; and when the at least one main arm is in the top position, the plane lying perpendicular to the second pivot axis and the fourth pivot axis forms a second angle in a range between 20° and 25°.

8. The container lifter of claim 1, further comprising at least one cylinder to compete a rotation of the seat in order to tip the container.

9. The container lifter of claim 1, wherein in an engagement position of a grasping system of the container, the a first angle defined by a second angle between a straight line passing through the third pivot axis and the fourth pivot axis, and first pivot axis and the second pivot axis, is in a range between −5° and +5°.

10. A rubbish collection vehicle, comprising:

a frame;

a propulsion system;

a caisson received by the frame and to store contents of containers; and a container lifter mounted to the frame, the container lifter having:

at least one main arm pivotably mounted about a first pivot axis so as to take a bottom position and a top position relative to a low-high direction;

a reinforcement member pivotably mounted to the at least one main arm about a second pivot axis;

a seat mounted to the reinforcement member and which is to receive a container so as to raise same; and at least one auxiliary arm pivotably mounted about a third pivot axis, and also pivotably on the reinforcement member about a fourth pivot axis;

wherein:

a spatial distance between the second pivot axis and the fourth pivot axis is greater than a spatial distance between the first pivot axis and the third pivot axis;

the seat is pivotably mounted to the reinforcement member about a fifth pivot axis so as to selectively take a position against the reinforcement member between the bottom position and the top position of the at least one main arm, and an unloading position when the at least one main arm is in the top position; and the seat is pivoted about the fifth pivot axis in such a way that the container received on the seat is also pivoted about the fifth pivot axis in order to be emptied of its contents.

11. The rubbish collection vehicle of claim 10, wherein the container lifter is mounted at a rear of the caisson, or at a side of the caisson.

12. The rubbish collection vehicle of claim 10, wherein a distance between a bottom position of the container lifter and a support surface of the rubbish collection vehicle is at least between 280 mm and 300 mm.

13. The rubbish collection vehicle of claim 12, wherein in the bottom position of the container lifter, a depth of the container lifter is less than 580 mm.

14. The rubbish collection vehicle of claim 10, wherein:

the spatial distance between the second pivot axis and the fourth pivot axis is greater, by at least 30%, than the spatial distance between the first pivot axis and the third pivot axis; and or a spatial distance between the third pivot axis and the fourth pivot axis is greater, by at least 10%, than a spatial distance between the first pivot axis and the second pivot axis; and/or the first pivot axis is spatially located above the third pivot axis and the second pivot axis is spatially located above the first pivot axis.

15. The rubbish collection vehicle of claim 14, wherein the fifth pivot axis is spatially located above the second pivot axis.

16. A method for emptying a container, the method comprising:

providing a container lifter having:

at least one main arm pivotably mounted about a first pivot axis so as to take a bottom position and a top position relative to a low-high direction;

a reinforcement member pivotably mounted to the at least one main arm about a second pivot axis;

a seat mounted to the reinforcement member and which is to receive a container so as to raise same; and at least one auxiliary arm pivotably mounted about a third pivot axis, and also pivotably on the reinforcement member about a fourth pivot axis;

wherein:

a spatial distance between the second pivot axis and the fourth pivot axis is greater than a spatial distance between the first pivot axis and the third pivot axis;

the seat is pivotably mounted to the reinforcement member about a fifth pivot axis so as to selectively take a position against the reinforcement member between the bottom position and the top position of the at least one main arm, and an unloading position when the at least one main arm is in the top position; and the seat is pivoted about the fifth pivot axis in such a way that the container received on the seat is also pivoted about the fifth pivot axis in order to be emptied of its contents, raising, in a first phase, the at least one main arm to attach the container to a comb of the seat, then raising the at least main arm further in order to raise the container to the starting of the closing of the clamp, and then closing the clamp on an upper edge of the container; and initiating, in a second phase, rotation of the container, then completing the rotation of the container using a cylinder.

17. The method of claim 16, wherein completing the rotation of the container is automatically started when the at least one main arm is in the stopped position.

18. The method of claim 16, wherein a tipping angle during the second phase is about 90° in order to reach an angle of inclination at emptying of about 42°.

19. The method of claim 16, wherein in the first phase, the closing of the clamp is executed continuously during the raising.

20. The method of claim 16, wherein in the first phase, the beginning of the closing of the clamp is triggered by an abutment position of the lifting cylinder.

* * * * *